United States Patent [19]

Jarred

[11] Patent Number: 4,887,975

[45] Date of Patent: Dec. 19, 1989

[54] FUSED ELECTRICAL RECEPTACLE

[76] Inventor: Ronald L. Jarred, 608 S. 20th, Leavenworth, Kans. 66048

[21] Appl. No.: 320,583

[22] Filed: Mar. 8, 1989

[51] Int. Cl.[4] ..... H01R 13/68

[52] U.S. Cl. ..... 439/490; 439/489; 439/622; 340/656

[58] Field of Search ..... 439/489, 490, 488, 620–622, 439/502, 503, 505; 340/654, 656

[56] References Cited

U.S. PATENT DOCUMENTS

| | | | |
|---|---|---|---|
| 3,924,914 | 12/1975 | Banner | 439/490 |
| 3,987,426 | 10/1976 | Jansen | 340/656 |
| 4,097,843 | 6/1978 | Basile | 439/489 |
| 4,155,082 | 5/1979 | Jones et al. | 340/656 |
| 4,178,061 | 12/1979 | Ahroni | 439/622 |
| 4,484,185 | 11/1984 | Graves | 439/490 |
| 4,500,160 | 2/1985 | Bertsch | 439/490 |

*Primary Examiner*—Gary F. Paumen
*Attorney, Agent, or Firm*—Jerry T. Kearns

[57] ABSTRACT

A fused electrical receptacle is particularly designed for use with an electrical waterbed heater. A housing includes a power cord extending therefrom for connection to a conventional AC outlet. A fuse is connected in line within the housing for providing circuit protection which prevents a shorted waterbed heater from damaging electrical circuits in a house and creating a potential fire hazard. An indicator is preferably provided within the housing for indicating when the fuse is blown. A solenoid coil may be connected to the power cord on a downstream side of the fuse and has an extensible rod disposed in a retracted position when the solenoid coil is energized and spring biased to an extended position when power supply to the solenoid coil is interrupted. A pivotal flag has a distal visual signal portion movable through an aperture in the housing between raised and lowered positions. A spring biases the flag to a lowered position and an actuating arm on the flag is disposed adjacent the solenoid coil rod for raising the flag upon failure of the fuse. An additional power indicating LED may be provided.

5 Claims, 3 Drawing Sheets

FUSED ELECTRICAL RECEPTACLE

BACKGROUND OF THE INVENTION

1. Field of the Invention

The present invention relates to fused electrical receptacles, and more particularly pertains to a fused electrical receptacle for use with electrical waterbed heaters. Such waterbeds utilizing electrical heaters create a shock as well as a fire hazard upon shorting of the waterbed. If such waterbed heaters are plugged directly into an AC wall outlet in a house, in the event of a short circuit it will take a direct route to the panel box in the house. This creates a potential for extensive damage for the electrical house wiring as well as a fire hazard. Additionally, many individuals have a great fear because of the proximity of a large quantity of water to the electrical waterbed heater. In order to provide an additional safety measure and to alleviate the fears of individuals, the present invention provides a fused electrical receptacle which provides fuse protection between the waterbed heater and the house wiring. The device also includes a pivoting indicating flag which indicates fuse failure.

2. Description of the Prior Art

Various types of fused electrical receptacles are known in the prior art. A typical example of such a fused electrical receptacle is to be found in U.S. Pat. No. 2,636,096, which issued to F. Di Blasi on Apr. 21, 1953. This patent discloses an adaptor for converting a single electrical outlet into a plurality of electrical outlets which include a replaceable internal fuse. U.S. Pat. No. 2,728,828, which issued to C. Mason on Dec. 27, 1955, discloses an electrical plug having a hollow interior portion housing a pair of replaceable fuses. U.S. Pat. No. 4,178,061, which issued to J. Ahroni on Dec. 11, 1979, discloses a fused electrical plug including a plug body having a pair of forwardly projecting conductor prongs for insertion into a socket. A pair of conductors entering the plug are connected to respective conductor prongs through fuses which are removable by opening an access door on a lateral face of the plug body. U.S. Pat. No. 4,275,374, which issued to D. Chaucer on June 23, 1981, discloses a fuse plug adaptor for an electrical cord for use with a string of Christmas lights. A plug includes a lower insertion opening the plug face, which the male prong elements extend from the plug such that when the plug is withdrawn from a socket a fuse may be inserted or withdrawn. U.S. Pat. No. 4,418,978, which issued to A. Shamir on Dec. 6, 1983, discloses a combination plug and fuse holder which provides fuse protection for appliances, extension cords, ornamental lighting and other electrical products wherein fuse protection is desirable. The fuse plug is of molded fire retardant plastic and has three separate members hinged together to form an integral unit.

While the above mentioned devices disclose fused electrical receptacles, none of these devices disclose a fused electrical receptacle adapted for protection of individuals utilizing electrically heated waterbeds and including an extensible indicating flag for visually indicating failure of the interior fuse. Inasmuch as the art is relatively crowded with respect to these various types of fused electrical receptacles, it can be appreciated that there is a continuing need for and interest in improvements to such fused electrical receptacles, and in this respect, the present invention addresses this need and interest.

SUMMARY OF THE INVENTION

In view of the foregoing disadvantages inherent in the known types of fused electrical receptacles now present in the prior art, the present invention provides an improved fused electrical receptacle. As such, the general purpose of the present invention, which will be described subsequently in greater detail, is to provide a new and improved fused electrical receptacle which has all the advantages of the prior art fused electrical receptacles and none of the disadvantages.

To attain this, a representative embodiment of the concepts of the present invention is illustrated in the drawings and makes use of a fused electrical receptacle particularly designed for use with an electrical waterbed heater. A housing includes a power cord extending therefrom for connection to a conventional AC outlet. A fuse is connected in line within the housing for providing circuit protection which prevents a shorted waterbed heater from damaging electrical circuits in a house and creating a potential fire hazard. An indicator is preferably provided within the housing for indicating when the fuse is blown. A solenoid coil may be connected to the power cord on a downstream side of the fuse and has an extensible rod disposed in a retracted position when the solenoid coil is energized and spring biased to an extended position when power supply to the solenoid coil is interrupted. A pivotal flag has a distal visual signal portion movable through an aperture in the housing between raised and lowered positions. A spring biases the flag to a lowered position and an actuating arm on the flag is disposed adjacent the solenoid coil rod for raising the flag upon failure of the fuse. An additional power indicating LED may be provided.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way It is therefore an object of the present invention to provide a new and improved fused electrical receptacle which has all the advantages of the prior art fused electrical receptacles and none of the disadvantages.

It is another object of the present invention to provide a new and improved fused electrical receptacle which may be easily and efficiently manufactured and marketed.

It is a further object of the present invention to provide a new and improved fused electrical receptacle which is of a durable and reliable construction.

An even further object of the present invention is to provide a new and improved fused electrical receptacle which is susceptible of a low cost of manufacture with regard to both materials and labor, and which accordingly is then susceptible of low prices of sale to the consuming public, thereby making such fused electrical receptacles economically available to the buying public.

Still yet another object of the present invention is to provide a new and improved fused electrical receptacle which provides in the apparatuses and methods of the prior art some of the advantages thereof, while simultaneously overcoming some of the disadvantages normally associated therewith.

Still another object of the present invention is to provide a new and improved fused electrical receptacle for protecting individuals utilizing electrically heated waterbeds.

Yet another object of the present invention is to provide a new and improved fused electrical receptacle which includes a visual indicator for indicating the failure of an internal fuse.

Even still another object of the present invention is to provide a new and improved fused electrical receptacle which utilizes a pop-up indicating flag for indication of failure of an internal fuse.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a schematic diagram illustrating the electrical components of the present invention.

DESCRIPTION OF THE PREFERRED EMBODIMENT

Figure 1:
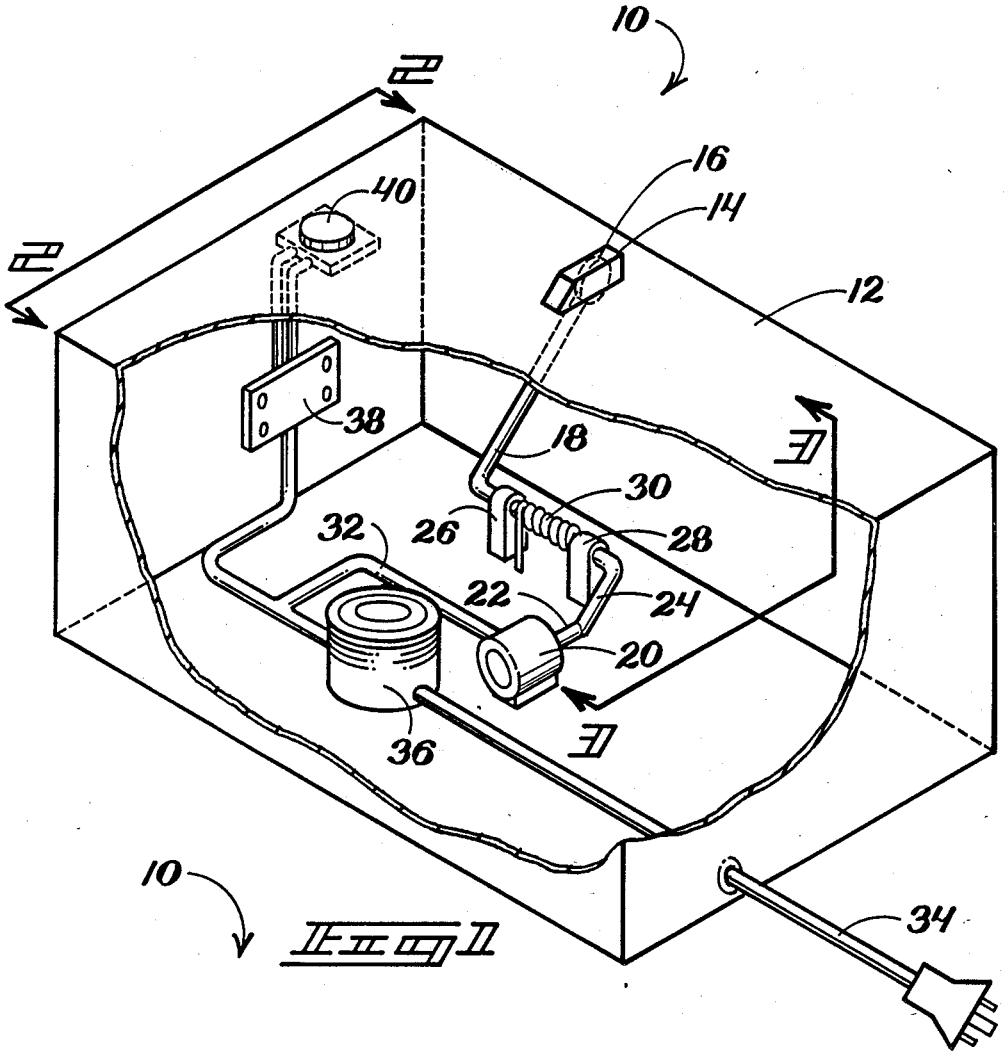
FIG. 1 is a perspective view, partially cut away, illustrating the fused electrical receptacle according to the present invention.

With reference now to the drawings, and in particular to FIG. 1 thereof, a new and improved fused electrical receptacle embodying the principles and concepts of the present invention and generally designated by the reference numeral 10 will be described.

More specifically, it will be noted that the first embodiment 10 of the invention includes a hollow generally rectangular housing 12 which includes an aperture or slot 14 which receives a distal visual indicating disc 16 of a pop-up indicating flag 18. The disc 16 is preferably painted with a fluorescent material to enable night time visibility. An interior fuse 36 is connected in line in a power cord 34 adapted for engagement in a conventional AC power outlet within a house. The fuse 36 includes a conventional fuse holder adapted to receive replaceable fuses. An electrical solenoid 20 is connected in the power cord 34 on a downstream side of the fuse 36 by a lid 32. The solenoid 20 is of the type which has an extensible rod 22 which is spring biased to an extended position upon power failure to the solenoid coil 20. The extensible solenoid rod 22 is disposed for abutment with an actuating arm 24 connected to the flag 18. A pair of spaced supports 26 and 28 mount the flag 18 for pivotal movement between raised and lowered positions. A torsional coil spring 30 surrounds the transverse flag staff portion, biasing the flag 18 and distal indicating portion 16 to a lowered position. Upon failure of the fuse 36, power to the solenoid 20 is interrupted causing the rod 22 to contact the actuating arm 24, moving the indicating flag 18 against the bias of the spring 30 to a raised position in which the distal indicating portion 16 extends upwardly through the aperture 14 formed in the top housing surface. This provides a positive visual indication of the failure of the internal fuse 36. Without such an indicating device, the power failure may not be apparent to individuals using an electrically heated waterbed until a substantial cooling of the water supply occurs. Upon such a substantial cooling, a relatively large amount of time is required to again heat the water to the desired temperature. The downstream side of the power cord 34 is connected to an additional power indicating LED 40 which is constantly illuminated until failure of the fuse 36 occurs. The power cord 34 terminates in an electrical outlet socket 38 adapted for connection with the waterbed heater and also with various other electrical appliances.

Figure 2:
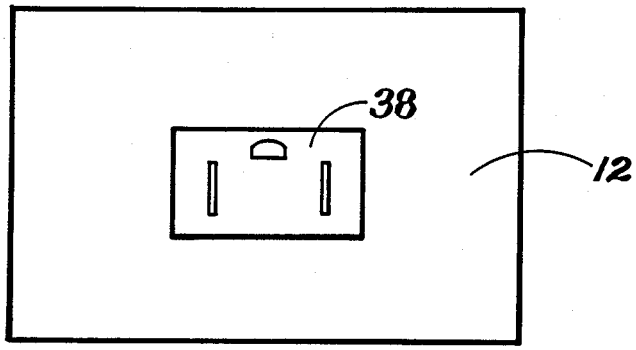
FIG. 2 is an end view illustrating the output electrical fused protected socket of the fused receptacle of the present invention.

FIG. 2 is an end view which illustrates the electrical output socket 38 on the end face of the housing 12.

Figure 3:
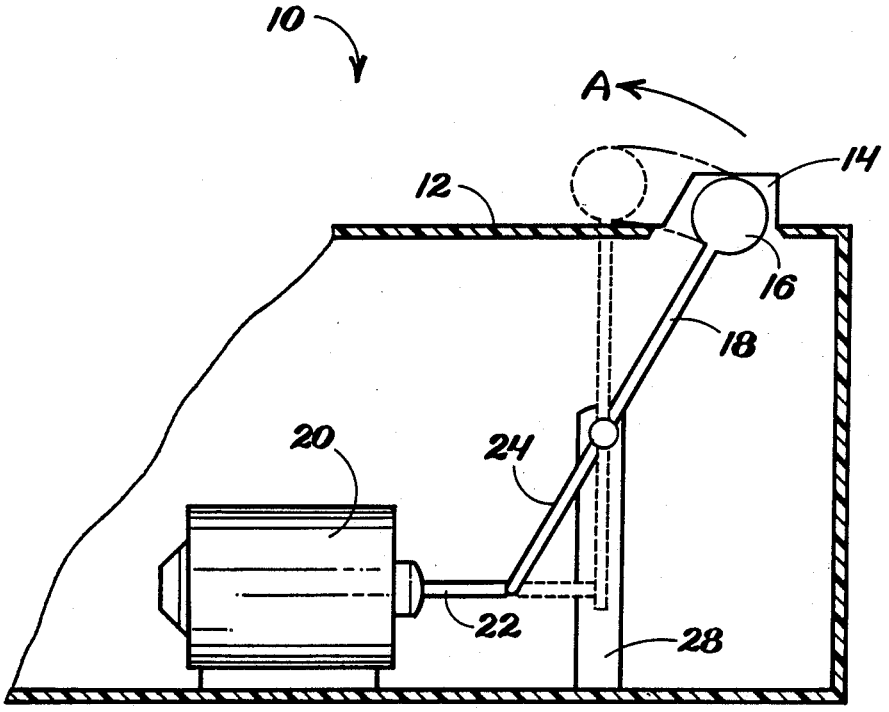
FIG. 3 is a cross sectional detail view, illustrating the manner of operation of a pop-up fuse failure indicating flag.
Figure 3:
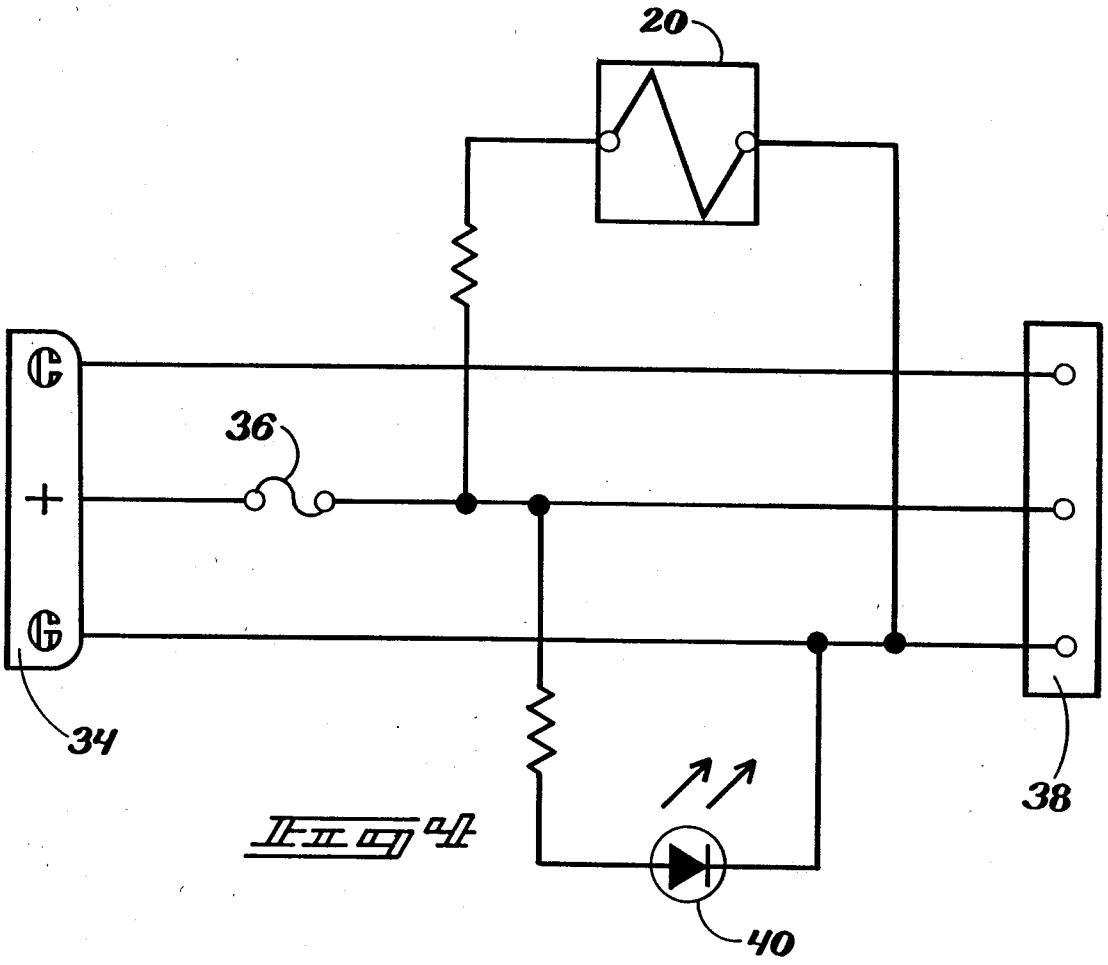

FIG. 3 is a cross sectional detail view, which illustrates the manner of operation of the indicating flag 18. Upon power interruption to the solenoid coil 20, the solenoid rod 22 will extend to the right as indicated, pivoting the actuating arm 24 and attached flag staff 18 to a raised position as indicated by arrow A. The slotted aperture 14 is provided in the top section of the housing 12 and allows the visual indicating distal end portion 16 to move to the raised position illustrated in phantom line.

FIG. 4 illustrates the schematic diagram of the electrical components of the present invention. Upon failure of the fuse 36 power will be interrupted to both the solenoid coil 20 and the power indicating LED 40, thus providing a dual indication of power failure to increase the chance of observation by an individual.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fused electrical receptacle, comprising:

a housing;

a power cord extending from said housing for connection to a conventional AC outlet;

said power cord extending to an electrical socket on said housing for connection of an electrical appliance to said socket;

a fuse within said housing connected to said power cord; and a pop up flag for indicating when said fuse is blown.

2. The fused electrical receptacle of claim 1, wherein said flag is actuated by extension of a solenoid rod upon failure of said fuse.

3. The fused electrical receptacle of claim 1, further comprising a power indicating light operably connected to said power cord via said fuse.

4. A fused electrical receptacle, comprising:

a housing;

a power cord extending from said housing for connection to a conventional AC outlet;

said power cord extending through said housing and terminating at an electrical socket for connection to an electrical appliance;

a fuse within said housing connected to said power cord;

a solenoid coil connected to said power cord via said fuse;

said solenoid including an extensible rod disposed in a retracted position when said solenoid coil is energized and spring biased to an extended position when power supply to said solenoid coil is interrupted by failure of said fuse;

a pivotal flag having a distal visual signal portion movable through an aperture in said housing between raised and lowered positions;

a spring biasing said flag to said lowered position; and an actuating arm on said flag disposed adjacent said solenoid rod for raising said flag upon failure of said fuse.

5. The fused electrical receptacle of claim 4, further comprising a power indicating LED connected to said fuse via said power cord.

* * * * *